US006609274B2

(12) United States Patent
Christensen et al.

(10) Patent No.: US 6,609,274 B2
(45) Date of Patent: Aug. 26, 2003

(54) REFRIGERATOR HANDLE ASSEMBLY

(75) Inventors: Jeffery C. Christensen, Galesburg, IL (US); Robert A. Christenson, Wataga, IL (US); Graham Carter Stevens, Arlington, MA (US)

(73) Assignee: Maytag Corporation, Newton, IA (US)

( * ) Notice: Subject to any disclaimer, the term of this patent is extended or adjusted under 35 U.S.C. 154(b) by 50 days.

(21) Appl. No.: 10/014,903

(22) Filed: Dec. 14, 2001

(65) Prior Publication Data

US 2003/0110591 A1 Jun. 19, 2003

(51) Int. Cl.[7] ..... E05B 1/00; E05B 5/00

(52) U.S. Cl. ..... 16/412; 16/436; 16/444; 16/DIG. 41; 312/405

(58) Field of Search ..... 16/412, 110.1, 16/111.1, 902, DIG. 40, DIG. 41, 410, 436, 439, 440, 444; 29/453, 469, 425.01; 62/440; 312/244, 405

(56) References Cited

U.S. PATENT DOCUMENTS

| | | | | | |
|---|---|---|---|---|---|
| 3,766,598 | A | | 10/1973 | Roberts | |
| 3,995,349 | A | | 12/1976 | Roberts et al. | |
| 4,087,141 | A | * | 5/1978 | Roberts | 312/348.6 |
| 4,357,734 | A | * | 11/1982 | Moore | 16/442 |
| 4,713,860 | A | | 12/1987 | Mobley et al. | |
| 4,745,656 | A | | 5/1988 | Revlett | |
| 4,926,523 | A | | 5/1990 | Carlson et al. | |
| 5,303,451 | A | | 4/1994 | Graviss et al. | |
| 5,440,783 | A | * | 8/1995 | Allardyce et al. | 16/110.1 |
| 5,493,756 | A | | 2/1996 | Shanok et al. | |
| 5,659,927 | A | | 8/1997 | Shanok et al. | |
| 5,675,867 | A | * | 10/1997 | Howie, Jr. | 16/412 |
| 5,740,587 | A | * | 4/1998 | Onai et al. | 16/412 |
| 5,771,537 | A | * | 6/1998 | Ho | 16/410 |
| 5,832,564 | A | | 11/1998 | Shanok | |

FOREIGN PATENT DOCUMENTS

| | | | |
|---|---|---|---|
| GB | 2227786 | | 8/1990 |
| JP | 3-217780 | | 9/1991 |
| JP | 10-103850 | | 4/1998 |
| JP | 11159944 | A * | 6/1999 |
| JP | 2001336872 | A * | 12/2001 |

* cited by examiner

*Primary Examiner*—Chuck Y. Mah
(74) *Attorney, Agent, or Firm*—Diederiks & Whitelaw, PLC

(57) ABSTRACT

A refrigerator handle assembly includes a main handle member, upper and lower extensions, and a base member. The main handle member is formed with an elongated upper cleat over which the upper extension snaps, an intermediate gripping portion, and a lower connecting portion including a cantilevered finger beneath which the base member extends. Each of the upper and lower portions of the main handle member is formed with slots which receive projections provided on the upper and lower extensions respectively. Detents provided on the upper and lower extensions are received beneath respective portions of the cleat and the base member in order to snap-fittingly interconnect the upper and lower extensions. The lower extension actually extends around both the terminal end of the main handle member and the base, while the upper extension extends about the elongated cleat. A tab formed on the cleat projects through a cut-out formed in the second extension.

20 Claims, 5 Drawing Sheets

REFRIGERATOR HANDLE ASSEMBLY

BACKGROUND OF THE INVENTION

1. Field of the Invention

The present invention pertains to the art of refrigerators and, more particularly, to a mounting arrangement for a handle assembly of a refrigerator.

2. Discussion of the Prior Art

Many conventional handle arrangements for refrigerators are formed from multiple pieces, including a handle frame and a handle piece having a gripping portion. Such a handle arrangement is typically mounted to a refrigerator cabinet utilizing screws which extend through the handle piece and frame, clamping the overall handle to a panel of the refrigerator cabinet. Once the handle is in place, a cover is inserted over the screws, with the cover extending either only over the area of the screws or along substantially the entire length of the handle. In general, this known handle mounting arrangement is rather hard to assemble and often results in witness lines that take away from the overall aesthetics of the refrigerator.

In certain refrigerators, gas assist handles are employed in an attempt to simplify the construction and assembly, while also improving the aesthetics. Such handle arrangements are also considered advantageous given their characteristic soft feel. Many known handle arrangements of this type also employ multiple handle pieces, including a main piece and one or more extensions, which can be interconnected or separately attached to a refrigerator door to form an overall handle assembly. When configuring such a handle arrangement, the manner in which the handle pieces are interconnected can greatly affect the overall aesthetics of the front of the refrigerator, as well as the ease of assembly. Based on known arrangements, there still exists a need in the art for an improved mounting arrangement of a refrigerator handle assembly, including a main handle portion and at least one extension, to a refrigerator door in a manner which provides a tight, aesthetically appealing and easily assembled overall arrangement.

SUMMARY OF THE INVENTION

The present invention is directed to a refrigerator handle assembly and the associated mounting thereof. The handle assembly preferably includes a main handle member, upper and lower extensions, and a base member. In accordance with the most preferred form of the invention, the main handle member is molded of plastic with an elongated upper cleat portion over which the upper extension snaps, an intermediate grip portion, and a lower connector element which guides the bottom extension into position. The main handle member is actually attached to a front face or panel of the refrigerator door along the elongated cleat portion and at the lower connector element. The base member extends from adjacent the lower connector element and is also attached to the face of the refrigerator, such as through the use of screws or the like. With the main handle portion and the base member secured, the upper and lower extensions are snapped into place to complete the overall assembly. Projections and detents associated with the extensions cooperate with structure on the main handle portion and base member to assure a tight and aesthetically pleasing arrangement.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF THE PREFERRED EMBODIMENTS

Figure 1:
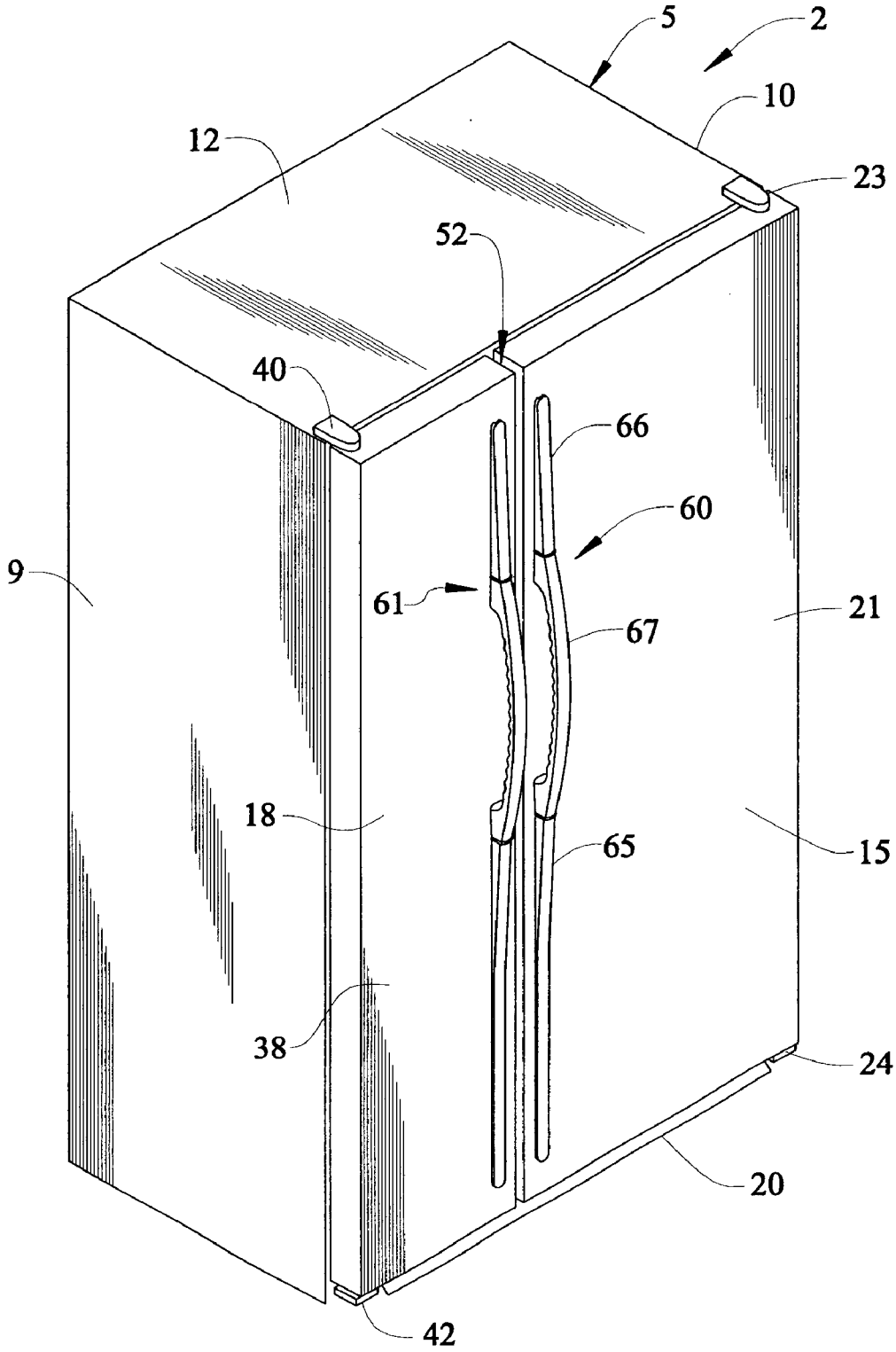
FIG. 1 is upper left perspective view of a refrigerator cabinet incorporating a refrigerator door handle assembly constructed in accordance with a preferred embodiment of the present invention.

With reference to FIG. 1, a handle assembly of the invention is shown mounted to a refrigerator cabinet which is generally indicated at 2. Initially, it should be noted that the handle assembly can be applied to various different types and styles of refrigerators. However, as shown, refrigerator cabinet 2 includes a cabinet shell 5 formed from side panels 9 and 10 which are interconnected by a top panel 12. Preferably, cabinet shell 5 is formed from bending a single piece of sheet metal in a manner known in the art. As illustrated, refrigerator cabinet 2 constitutes a side-by-side refrigerator having a fresh food compartment door 15 which is arranged laterally juxtaposed a freezer door 18. Extending laterally across cabinet shell 5, below fresh food and freezer doors 15 and 18, is a kickplate 20.

Fresh food door 15 includes an outer vertical edge portion 21 which is pivotally attached to cabinet shell 5 through an upper hinge 23 and a lower hinge 24. In a generally similar manner, freezer door 18 includes an outer edge portion 38 which is pivoted at upper hinge 40 and lower hinge 42 for movement relative to cabinet shell 5. In a manner widely known in the art, side-by-side refrigerator cabinet 2 has inner edge portions of fresh food and freezer doors 15 and 18 spaced by a vertical gap 52. As also widely known, fresh food and freezer doors 15 and 18 conceal fresh food and freezer compartments of refrigerator cabinet 2. Aside from the aspects which will be described more fully below, the basic construction and operation of refrigerator cabinet 2 is known in the art, does not form part of the present invention, and therefore will not be discussed further herein.

The present invention is actually directed to the mounting of handle assemblies 60 and 61 for fresh food and freezer doors 15 and 18 respectively. As shown, each handle assembly 60, 61 includes a first, elongated extension or extension 65, a second extension or extension 66, and an intermediate, main body portion 67 interposed between the first and second extensions 65 and 66. At this point, it should be understood that the exact configuration of handle assemblies 60 and 61 merely represents a preferred arrangement and various handle designs could be readily employed without departing from the invention.

Reference will now be made to FIGS. 2–5 in describing the preferred mounting of handle assembly 61 in accordance with the present invention and it is to be understood that handle assembly 60 is constructed and mounted in a corresponding manner. With initial reference to FIG. 2, main body portion 67 is preferably molded of plastic and includes a gripping section 72 leading to first and second ends 74 and 75. Handle assembly 61 also incorporates a base member 80 having a plurality of longitudinally spaced holes 85–89 through which screws (not shown) can extend for attaching base member 80 to door 18 of refrigerator cabinet 2. As also shown in this figure, first extension 65 of handle assembly 61 defines an open end 94 and a closed end 95. Preferably, first extension 65 is also molded of plastic and tapers from open end 94 to closed end 95. As will be detailed more fully below, first extension 65 is adapted to be snap-fit about both first end 74 of main body portion 67 and base member 80. Second extension 66 is constructed in a manner similar to first extension 65, with an open end 98 and a substantially closed end 99. Also, for reasons will be discussed further below, closed end 99 is provided with a cut-out 102.

Figure 3:
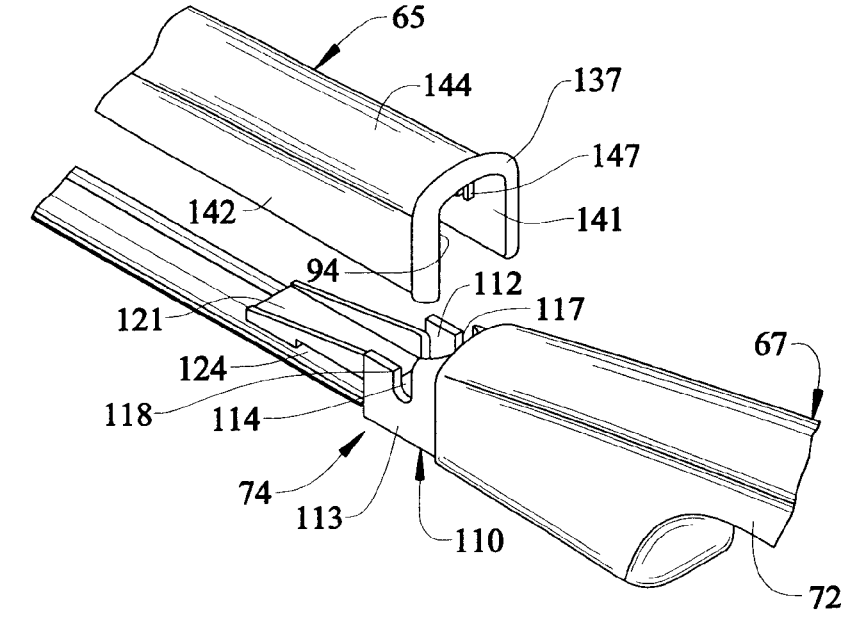
FIG. 3 is an enlarged view of a portion of the mounting structure for the handle assembly of FIGS. 1 and 2.

FIG. 3 is a detailed view of handle assembly 61 in the vicinity of first end 74. As shown, first end 74 is formed with a U-shaped connector 110, preferably defined by integrally molded side walls 112 and 113 that are integrated by a base 114. Although not shown due to the angle presented, base 114 is provided with a through hole which enables first end 74 to be directly attached to door 18, preferably by a mechanical fastener. Each side wall 112, 113 is formed with a respective open-ended slot 117, 118. In the preferred embodiment shown, slots 117 and 118 are directly opposite one another. First end 74 also includes a cantilevered finger member 121 which projects from U-shaped connector 110 at a position spaced above base 114. With this arrangement, as clearly shown in FIG. 3, a terminal extension 124 of base member 80 can be positioned under finger member 121 and abut against U-shaped connector 110 when handle assembly 61 is mounted upon door 18.

Figure 5:
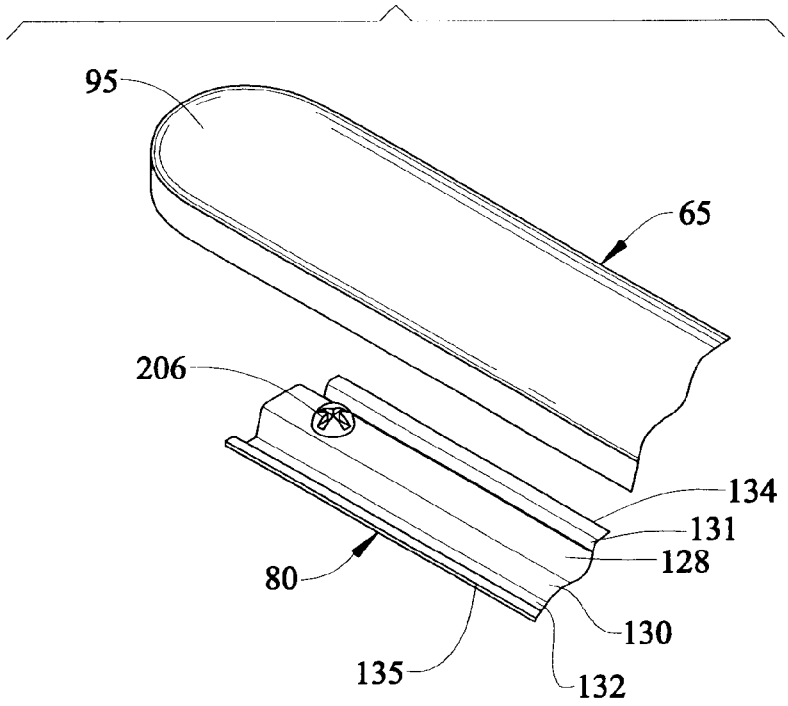
FIG. 5 is an enlarged view of one terminal end of the handle assembly of the invention.
Figure 7:
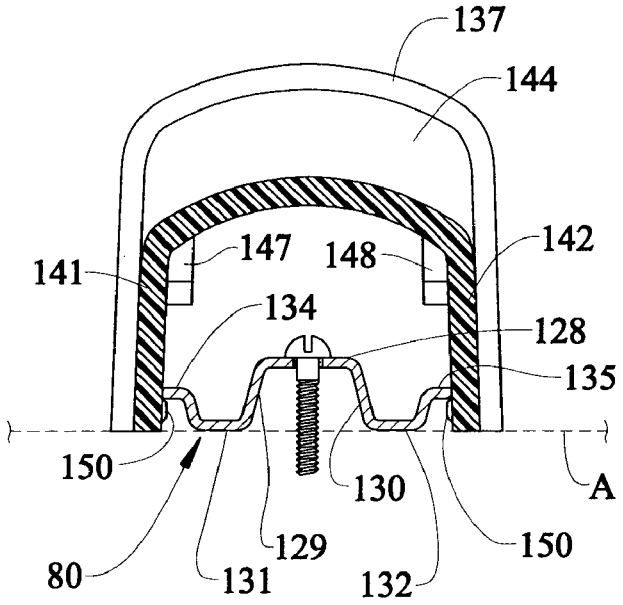
FIG. 7 is a cross-sectional view showing an interconnection between a base member, constructed in accordance with a first embodiment of the invention, and an extension portion of the handle assembly.

Base member 80 is perhaps best shown in FIGS. 3, 5 and 7. In this preferred embodiment, base member 80 is preferably formed of metal with a substantially flat central section 128, angled side wall sections 129 and 130, additional flat transverse sections 131 and 132, and outwardly projecting lateral flange sections 134 and 135. Although the exact configuration of base member 80 could vary greatly in accordance with the present invention, it is important to note that, upon mounting of base member 80 to door 18, lateral flange sections 134 and 135 will be slightly spaced from the front surface of door 18 as illustrated in FIG. 7 utilizing dotted line A to represent the front surface of door 18.

Figure 2:
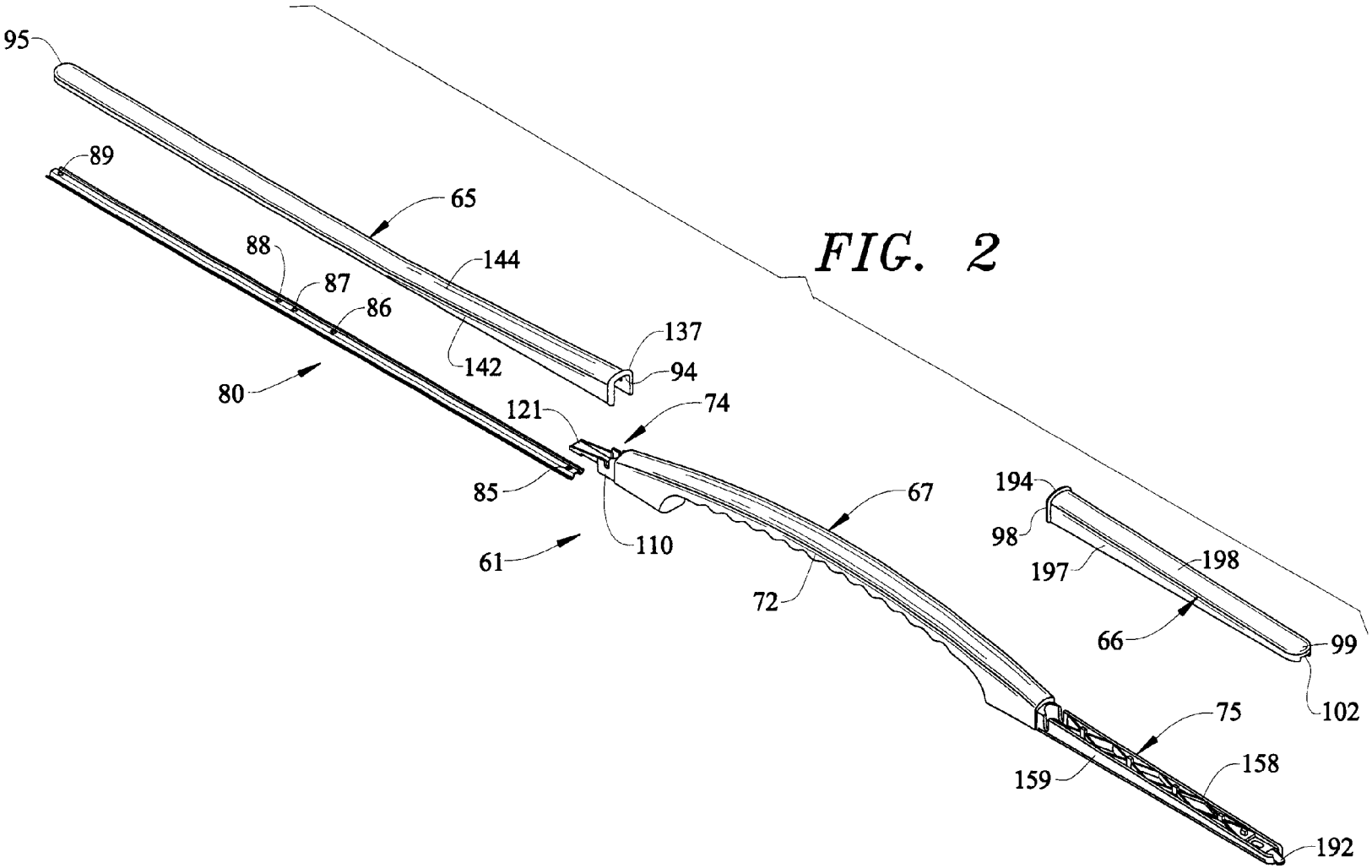
FIG. 2 is an exploded view of the handle assembly of FIG. 1.

As also particularly shown in at least FIGS. 2 and 3, first extension or extension 65 of handle assembly 61 preferably includes a terminal, enlarged rim 137 leading to opposing side walls 141 and 142 which are joined by a connecting wall 144. Extension 65 is also preferably molded of plastic. In accordance with the most preferred embodiment of the invention, each of side walls 141 and 142 are integrally molded with respective projections 147 and 148 adjacent rim 137. More specifically, each projection 147, 148 leads from connecting wall 144 and extends along a portion of a respective side wall 141, 142. As will be detailed more fully below, projections 147 and 148 preferably cooperate with open ended slots 117 and 118 to properly align extension 65 for mounting over and about base member 80 and U-shaped connector 110. Furthermore, at positions spaced from connecting wall 144, each of side walls 141 and 142 are preferably formed with longitudinally spaced and inwardly projecting detents 150. In essence, detents 150 represent small projections generally in the order of ¼" in length and approximately 1/16" in height which are provided along side walls 141 and 142 at spaced intervals. In the most preferred embodiment of the invention, detents 150 are spaced in the order of 6" along each side wall 141, 142. As will be detailed more fully below, detents 150 are adapted to be received at predetermined locations beneath a respective lateral flange section 134 and 135 when extension 65 is mounted over and about base member 80 and U-shaped connector 110.

Figure 4:
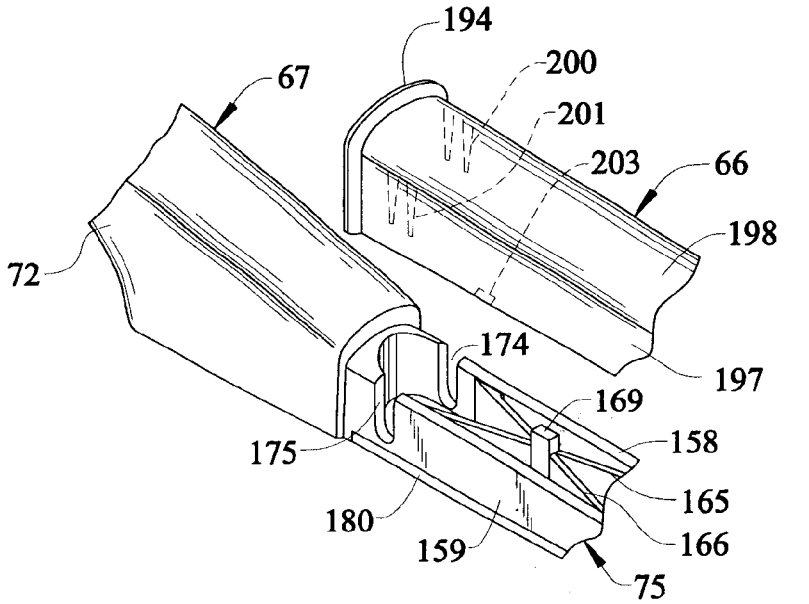
FIG. 4 is an enlarged view of another portion of the mounting structure for the handle assembly of the invention.
Figure 6:
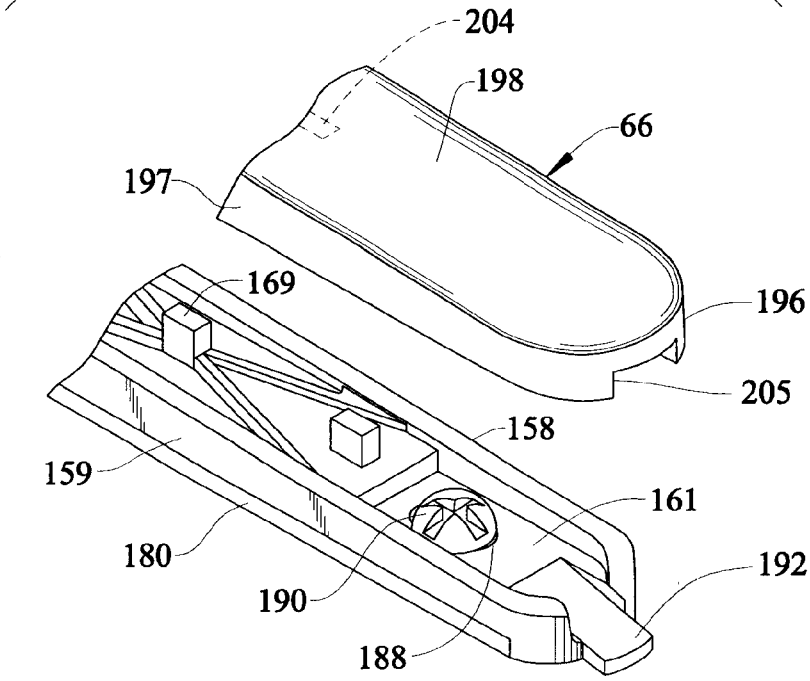
FIG. 6 is an enlarged view of an opposing terminal end of the handle assembly of the invention.

Reference will now be made to FIGS. 2, 4 and 6 in describing the preferred construction of second end 75 of main body portion 67. As indicated above, second end 75 generally defines a cleat used to mount main body portion 67 to door 18, while accommodating the attachment of extension 66 thereto. As shown, cleat 75 is preferably integrally molded with gripping section 72 and is formed with opposing side walls 158 and 159 which project up from a base 161. Various cross ribs 165 and 166 are provided for reinforcing purposes. In addition, a plurality of longitudinally spaced, locating pegs 169 project upwardly from base 161, with a majority of pegs 169 being intersected by respective cross ribs 165 and 166.

Adjacent gripping section 72, cleat 75 is formed with slots 174 and 175 in side walls 158 and 159 respectively. At this location, base 161 is preferably formed with a hole (not shown) adapted to receive a screw for directly attaching cleat 75 directly to door 18. As represented in these figures, an elongated side recess 180 is provided in side wall 159 directly at base 161. A corresponding elongated side recess is also provided along side wall 158. As will be discussed more fully below, these elongated side recesses 180 are used in connection with snap-fitting second extension or extension 66 of handle assembly 61 to cleat 75. At an end of cleat 75 remote from gripping section 72, base 161 is provided with a hole 188 which receives a screw 190 for securing this end of cleat 75 to door 18. As also shown, this end of cleat 75 is preferably provided with a forwardly projecting tab 192.

In a manner similar to extension 65, extension 66 is preferably integrally molded of plastic with a terminal rim 194, side walls 196 and 197 and a connecting wall 198. Extension 66 is also provided with projections which are shown in phantom at 200 and 201 in FIG. 4 adjacent terminal rim 194. Projections 200 and 201 directly correspond in construction to projections 147 and 148, while being adapted to be received in slots 174 and 175 when extension 75 is positioned over and about cleat 75. Extension 66 is also provided with various detents 203 at spaced intervals along side walls 196 and 197 in a manner directly analogous to detents 150. In addition, connecting wall 198, along the inside of extension 66, is preferably formed with various recessed areas 204 (see FIG. 6) which are adapted to be directly aligned with respective ones of locating pegs 169 when extension 66 is placed about and connected to cleat 75. Furthermore, extension 66 is provided with a cut-out 205 that is adapted to receive tab 192 upon mounting of extension 66 to cleat 75 as will be detailed below.

During assembly of handle assembly 61 to door 18, base member 80 is initially mounted to door 18 via screws, one of which is indicated at 206 in FIG. 5, extending through at least selected one of holes 85–89. Again, when mounted, base member 80 has lateral flange sections 134 and 135 which are raised from the front surface of door 18. Thereafter, main body portion 67 is arranged so as to have finger member 121 atop a portion of base member 80, with base member 80 abutting U-shaped connector 110. Main body portion 67 is then attached through various screws 190 or other mechanical fasteners extending through the holes provided in U-shaped connector 110 and cleat 75.

At this point, gripping section 72 is firmly attached to door 18, with cleat 75 being positioned higher along door 18 than base member 80. To complete the overall assembly, extensions 65 and 66 are adapted to be snap-fittingly connected over and about base member 80 and cleat 75 respectively. More specifically, extension 65 is adapted to be placed over and about both base member 80 and U-shaped connector 110, with projections 147 and 148 being received in respective slots 117 and 118 in order to properly locate extension 65 relative to main body portion 67 and base 80. When in the proper position, side walls 141 and 142 of extension 65 will extend about side walls 112 and 113 of U-shaped connector 110, as well as base member 80, until detents 150 are pushed past lateral flange sections 134 and 135. At this point, side walls 141 and 142 slightly bend to permit detents 150 to initially extend about lateral flange sections 134 and 135 and then snap back toward each other such that detents 150 are positioned below lateral flange sections 134 and 135 as clearly shown in FIG. 7. Due to the positioning of projections 147 and 148 relative to slots 117 and 118, rim 137 is caused to be located directly adjacent gripping section 72 in order to establish an extremely aesthetic overall handle arrangement.

In a similar manner, extension 66 is adapted to be snap-fit over and about cleat 75, with projections 200 and 201 extending into slots 174 and 175, and detents 203 being snap-fittingly received within a corresponding elongated side recess 180. When mounted in this fashion, tab 192 of cleat 75 also projects through cut-out 205, while various locating pegs 169 are received within respective recessed areas 204, in order to securely locate and maintain extension 66 in a desired position. If removal of extension 66 is required, a tool, such as a screw driver or the like, can be readily inserted between tab 192 and a portion of extension 66 at cut-out 205 in order to pry extension 66 from atop cleat 75. A similar cut-out could be provided for extension 65 for a corresponding purpose as well.

Figure 8:
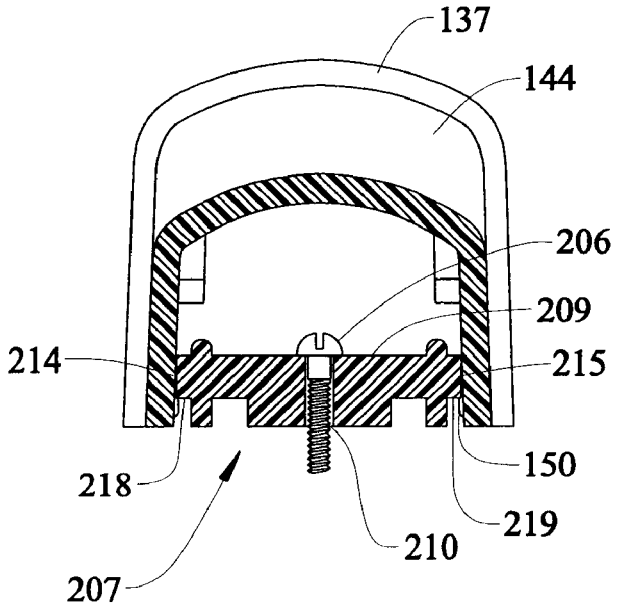
FIG. 8 is a cross-sectional view, similar to that of FIG. 7, showing an interconnection between a base member, constructed in accordance with a second embodiment of the invention, and an extension portion of the handle assembly.

At this point, attention is drawn to the arrangement shown in FIG. 8 wherein base member 80 has been replaced by a plastic base member 207. In essence, this presents the only change made to the overall handle assembly of the invention with this embodiment. In any event, base member 207 is shown to include a central portion 209 provided with a plurality of longitudinally spaced through holes, one of which is indicated at 210. Through holes 210 are adapted to receive respective screws 206 for mounting of base member 207 to door 81. In order to enable extension 65 to be snap-fit about base member 207 in a manner directly corresponding to that associated with base member 80, base member 207 is formed with side walls 214 and 215 that have undercuts 218 and 219. Therefore, when extension 65 is placed over and about base member 207 in accordance with this embodiment, detents 150 will enable a snap-fit in a manner directly corresponding to that described above.

Although described with reference to preferred embodiments of the invention, it should be readily understood that various changes and/or modifications can be made to the invention without departing from the spirit thereof. In any event, based on the above, it should be readily apparent that integrally molding gripping section 72 with elongated cleat 75 minimizes the number components which need to be aligned and separately fastened to refrigerator cabinet 2. In addition, given the construction of first end 74, the alignment and relative mounting with base member 80 or 207 is enhanced. Furthermore, given the cooperation between the various projections 147, 148 and 200, 201 with slots 117, 118 and 174, 175, the seam lines between gripping section 72 and each of extensions 65 and 66 are made essentially unnoticeable. Specifically, it should be realized that the various projections 147, 148 and 200, 201 will abut portions of side walls 112, 113 and 158, 159 at slots 117, 118 and 174, 175 respectively, to assure that extensions 65 and 66 are extremely close to gripping section 72. Therefore, this mounting arrangement assures an advantageous unitary look to the overall handle assembly 60 or 61. Of course, although multiple projections are shown arranged adjacent one another, enlarged projections could be used to extend across the entire slots. Finally, the manner in which detents 150 and 203 become interengaged at lateral flange sections 134 and 135, and elongated side recesses 180 respectively, represents a rather quick and efficient assembly arrangement. Regardless of this preferred construction, the invention is only intended to be limited by the scope of the following claims.

We claim:

1. In a refrigerator including a cabinet defining an interior compartment and at least one door, having a front side, pivotally mounted to the cabinet for selectively accessing the compartment, a handle assembly for the door comprising:

a base member fixed to the door along a portion of the front side, said base member having first and second longitudinally spaced ends;

a main body member including a first terminal extension positioned adjacent the first end of the base member, a second terminal extension which defines an elongated cleat, and a central gripping portion which is spaced from the front side of the door to enable the main body member to be grasped in order to selectively open and close the door, said main body portion being fixed to the door at each of the first and second extensions;

a first extension extending about both the first terminal extension of the main body portion and the base member, with said first extension being snap-fittingly connected to the base member; and a second extension extending about and being snap-fittingly attached to the cleat.

2. The handle assembly according to claim 1, wherein the first terminal extension includes a cantilevered finger member under which the base member extends.

3. The handle assembly according to claim 2, wherein the first terminal extension further includes a U-shaped connector, said cantilevered finger projecting from the U-shaped connector, said first extension extending over and about each of the U-shaped connector, the cantilevered finger and the base member.

4. The handle assembly according to claim 1, wherein the first terminal extension of the main body member is formed with at least one open-ended slot and the first extension is provided with at least one projection which is received in the at least one slot to locate the first extension relative to the main body member.

5. The handle assembly according to claim 4, wherein the at least one slot includes a pair of opposed, open-ended slots and the at least one projection includes a pair of opposed, side wall projections provided on the first extension.

6. The handle assembly according to claim 5, further comprising: a rim provided on the first extension, with the rim being positioned directly adjacent the main body member.

7. The handle assembly according to claim 4, wherein the base member includes a pair of lateral flange sections which are spaced from the front side of the door and the first extension includes a plurality of detents which are snap-fit beneath the lateral flange sections.

8. The handle assembly according to claim 1, wherein the second terminal extension includes a pair of spaced side walls which are interconnected by a base, said base defining at least two connection points at which the cleat is directly mounted to the door.

9. The handle assembly according to claim 8, wherein said second terminal extension further includes a plurality of ribs interconnecting the side walls and a plurality of longitudinally spaced pegs interposed between the ribs.

10. The handle assembly according to claim 8, wherein each of the side walls is formed with an elongated side recess and the second extension is provided with a plurality of detents, each of said detents extending into a respective one of the side recesses to snap-fit the second extension to the cleat.

11. The handle assembly according to claim 10, wherein the second terminal extension is provided with at least one slot and the second extension is provided with at least one projection which extends into the slot to locate the second extension relative to the main body member.

12. The handle assembly according to claim 10, wherein the at least one slot includes a pair of opposed, open-ended slots and the at least one projection includes a pair of opposed, side wall projections provided on the second extension.

13. The handle assembly according to claim 10, further comprising: a rim provided on the second extension, with the rim being positioned directly adjacent main body member.

14. The handle assembly according to claim 8, wherein the second terminal extension is provided with a tab which projects away from the central gripping portion, said second extension being formed with a cut-out through which the tab projects.

15. A method of assembling a handle to a front side of a pivotally mounted door of a refrigerator cabinet comprising:

fixedly securing base and main body members along portions of the front side of the door;

covering both a portion of the main body member and the base member with a first extension which is snap-fittingly connected to the base member; and snap-fittingly connecting a second extension about an elongated cleat portion of the main body member, remote from the base member.

16. The method of claim 15, further comprising: engaging detents provided on the first extension beneath lateral flanges of the base member in order to snap-fittingly connect the first extension to the base member.

17. The method of claim 15, further comprising: positioning detents formed in the second extension into elongated side recesses formed in the cleat portion of the main body member in order to snap-fittingly connect the second extension to the main body member.

18. The method of claim 15, further comprising: positioning projections formed on the first and second extensions into respective slots formed in the main body member in order to locate the first and second extensions relative to the main body member.

19. The method of claim 15, further comprising: positioning the base member beneath a cantilevered finger provided at a first terminal extension of the main body member.

20. The method of claim 15, further comprising: arranging a tab formed integral with the cleat portion of the main body member to project through a cut-out formed in the second extension as the second extension is snap-fittingly attached to the main body member.

* * * * *